United States Patent [19]

Sawazaki et al.

[11] Patent Number: 4,534,187

[45] Date of Patent: Aug. 13, 1985

[54] SLIDING LATCH NEEDLES

[75] Inventors: Masatoshi Sawazaki; Shozo Yorisue, both of Kobe, Japan

[73] Assignee: Precision Fukuhara Works, Ltd., Kobe, Japan

[21] Appl. No.: 648,931

[22] Filed: Sep. 10, 1984

[30] Foreign Application Priority Data

Oct. 6, 1983 [JP] Japan ..... 58-187529

[51] Int. Cl.[3] ..... D04B 35/04

[52] U.S. Cl. ..... 66/120

[58] Field of Search ..... 66/120, 123

[56] References Cited

U.S. PATENT DOCUMENTS 4,109,490 8/1978 Bosch ..... 66/120

4,448,044 5/1984 Kühnert ..... 66/120

4,448,045 5/1984 Kühnert ..... 66/120

FOREIGN PATENT DOCUMENTS 2070075 9/1981 United Kingdom ..... 66/120

*Primary Examiner*—Ronald Feldbaum

*Attorney, Agent, or Firm*—Nathan Levin

[57] ABSTRACT

Sliding latch needles used in slots of rotary cylinders of circular knitting machines wherein the latches are subject to centrifugal force which moves the latches radially outwardly of the needle slots away from their proper position relative to the needle hooks. The hooks are provided with apertures extending completely through the same and through which the latches extend from the rear side of the hook to abut against the hook and thereby to retain the latches from movement away from the hook.

6 Claims, 17 Drawing Figures

Figure 1:
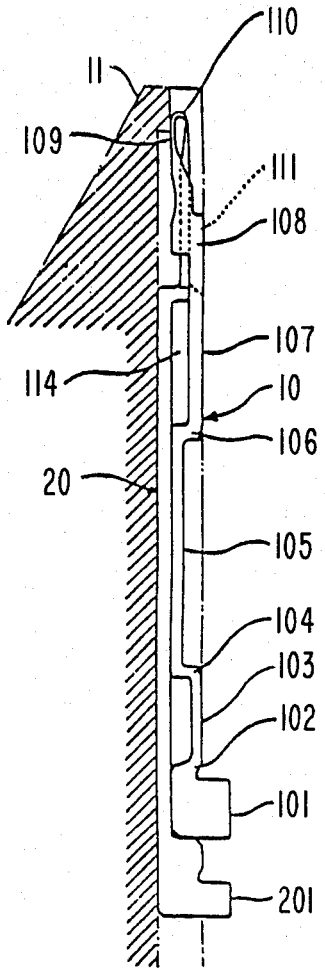

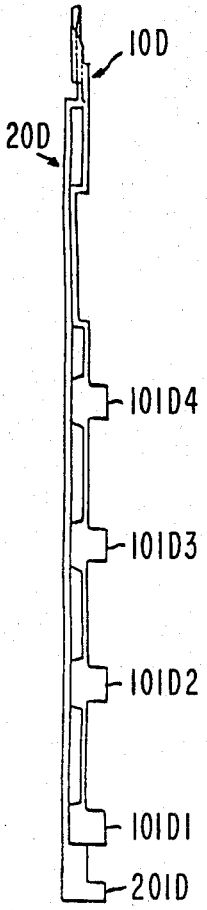
Fig. 9.
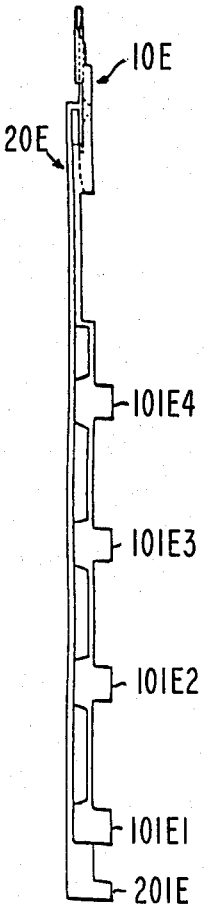
Fig. 10.
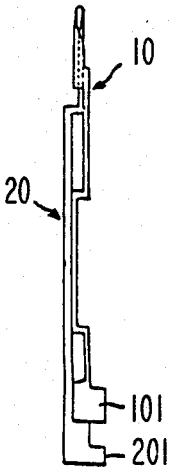
Fig. 8A.
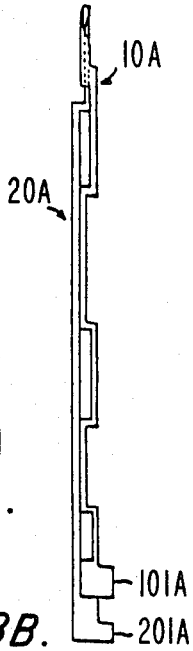
Fig. 8B.
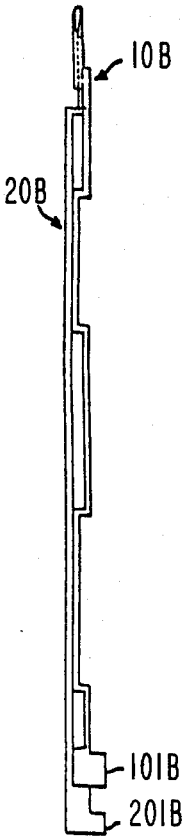
Fig. 8C.
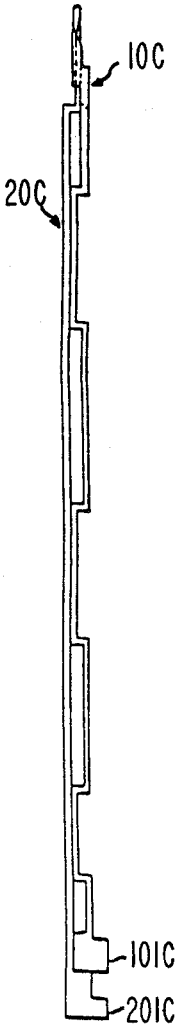
Fig. 8D.
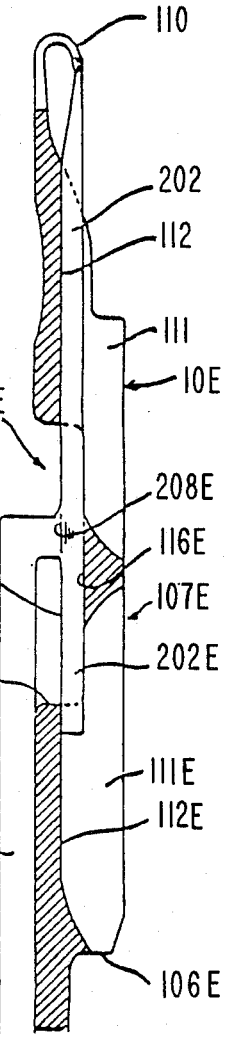
Fig. 11.
Fig. 12.
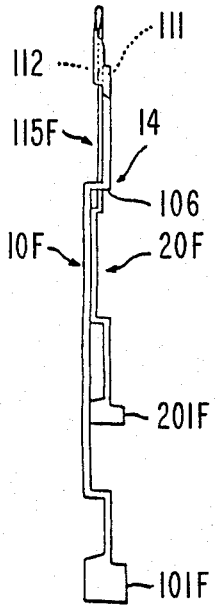
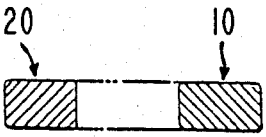
Fig. 6.
Fig. 7.
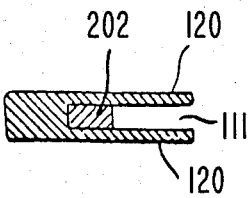
Fig. 14.
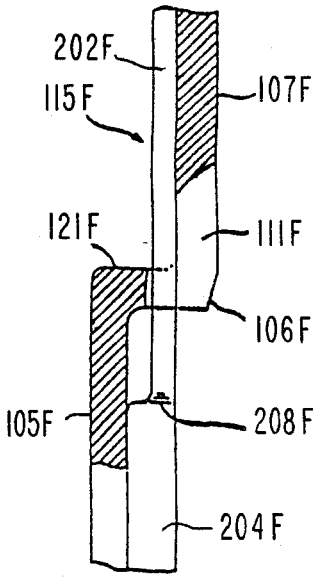

SLIDING LATCH NEEDLES

The present invention relates generally to the art of knitting and more particularly to sliding latch needles used in circular knitting machines.

Sliding latch needles, also known as compound needles, generally comprise an assembly of lengthwise extending hook and latch sections. The hook section has an operating butt at one end thereof and a hook at its other end, while the latch section has an operating butt at one end thereof and a latch at its other end. The hook and latch sections reciprocate relative to each other in known manner to make knit fabric.

In the sliding latch needle shown in Japanese Patent Publication No. Sho 56-118934, the hook section reciprocates in the slots of the needle cylinder while the latch section reciprocates in slots formed in the hook section. The butts of the latch section are between the butts of the hook section and of their hooks. The walls of the slot in the hook section are formed to retain the latches therein so that the latches cover and uncover the hooks during the knitting operation. However, in the use of such prior art sliding latch needles in the needle slots of rotary needle cylinders, it has been found that the latches are some times forced radially outwardly of the slots in the hook section with the result that the latch does not properly cover the hook and defective fabric results.

It is the principal object of the present invention to provide sliding latch needles in which the latches are prevented from movement radially outwardly of the needles.

It is also an object of the invention to provide a sliding latch needle having an assembly of hook and latch sections in which the latch section reciprocates in the needle cylinder slots and in which the hook section reciprocates upon the latch section in the needle cylinder slots. The hook section is provided with a slot extending therethrough by means of which the latch extends through the hook section to its position relative to the hook. In this arrangement the butts of the hook section are between their hooks and the butts of the latch sections. The hook sections press against the latch sections to retain the latches against radially outward movement.

With the above and other objects in view as will become apparent from the accompanying drawings and the description thereof, the invention resides in the improvement in sliding latch needles as shown and as described and as set forth in the appended claims.

Figure 2:
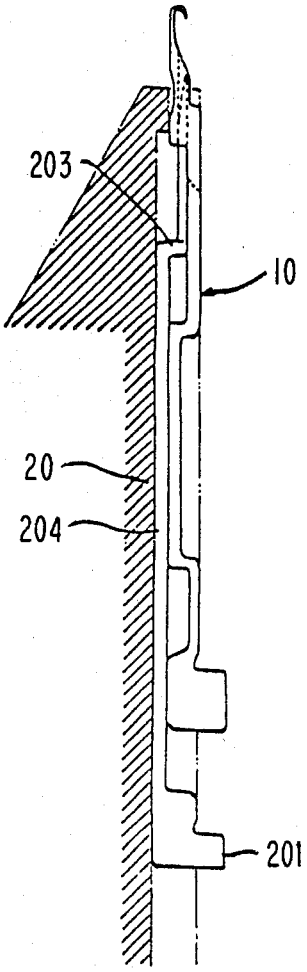
Figure 13:
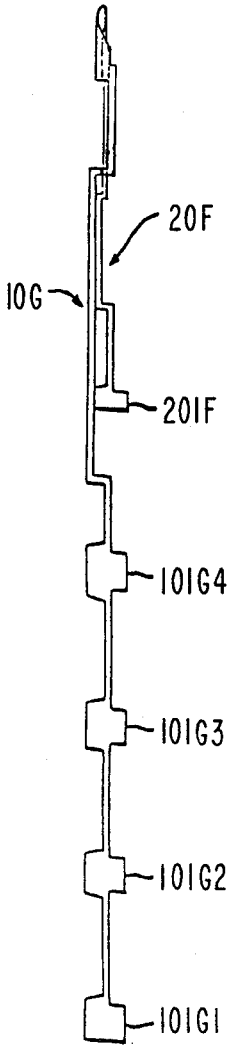
Figure 3:
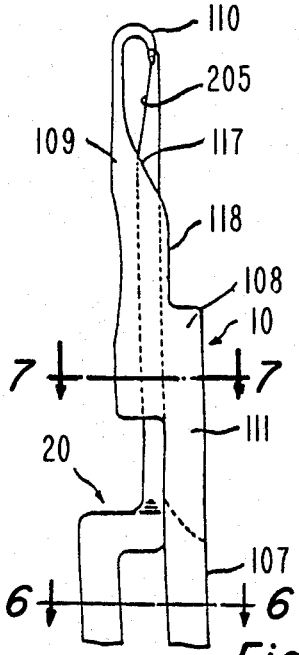
Figure 4:
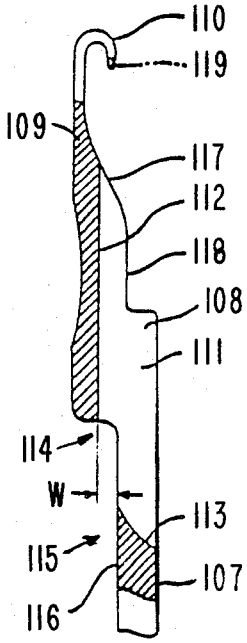
Figure 5:
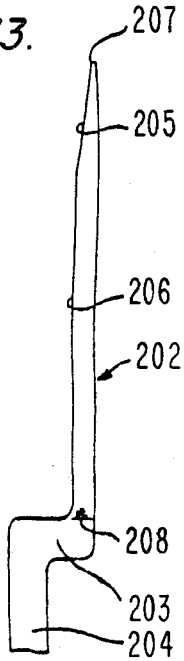

In the drawings:

FIG. 1 is a side elevational view of a first example of the sliding latch needle of the present invention, the needle being formed of a hook section and of a latch section, and being shown in closed position in a needle slot of a needle cylinder of a circular knitting machine, FIG. 2 is a view similar to FIG. 1 with the needle in open position, FIG. 3 is an enlarged view of the hook and latch sections shown in FIG. 1, FIG. 4 is a sectional view of the hook section shown in FIG. 3, FIG. 5 is a view of the latch section shown in FIG. 3, FIG. 6 is an enlarged sectional view on line 6—6 of FIG. 3, FIG. 7 is an enlarged sectional view on line 7—7 of FIG. 3, FIG. 8A is a schematic side elevational view in outline of the first example of the present invention, FIGS. 8B, 8C and 8D are views generally similar to FIG. 8A showing a second, a third and a fourth example of the present invention, FIG. 9 is a schematic side elevational view in outline of a fifth example of the present invention, FIG. 10 is a view generally similar to FIG. 9 showing a sixth example of the present invention, FIG. 11 is an elarged side elevational view, partly in section, of the hook and latch sections of FIG. 10, FIG. 12 is a schematic side elevational view of a seventh example of the present invention, FIG. 13 is a view generally similar to FIG. 12 showing an eighth example of the present invention, and FIG. 14 is an elarged view, partly in section, showing a portion of the hook and latch sections at 14 in FIG. 12.

A first example of the sliding latch needle of the present invention is shown in FIGS. 1 and 2 as being formed of an assembly of a hook section 10 and of a latch section 20.

The hook section 10 comprises a lengthwise extending shank member having an operating butt 101 at one end thereof and a hook 110 at its other end. The shank member is in the form of lengthwise extending staggered segments 103, 105, 107 and 109 which are joined by laterally extending segments 102, 104, 106 and 108. The staggered or meanderform arrangements of the shank segments serves to dampen vibrations transmitted to the needles during the knitting operation. The butt and the hook extend from the same side of the shank. As shown in FIGS. 3 and 4, a slot 111 having spaced sidewalls 120, 120 and having a rectilinear shaped bottom 112 is formed in the butt side of segments 107, 108 and 109 of hook section 10. One end of slot 111 terminates in a concave shaped arc 113 located in the upper end of segment 107 and below segment 108. As a result, an aperature 114 is formed which extends completely through the upper end in segment 107 between its butt and non-butt sides. One end of aperture 114 is in an area 115 between segments 107 and 108. The distance between bottom 112 of slot 111 and the non-butt side of segment 107 is shown at W. As will be explained, sliding latch section 20 is received within aperture 114 of hook section 10 during assembly of the hook and latch sections as well as during operation of the needle itself. The other end of slot 111 intersects with and terminates in a sloping surface 117 in segment 109 between walls 120, 120. The sloping surface continues to edges 118 of the sidewalls wherein the distance between edges 118 and the bottom of slot 11 is slightly more than the aforesaid distance W.

The sliding latch 20 comprises a lengthwise extending shank member 204 having an operating butt 201 at one end thereof and having a lengthwise extending latch 202 at its other end, the latch being joined to its shank by a laterally extending segment 203 disposed therebetween. Butts 101, 102 are in the same plane and extend in the same direction as the hook of the needle. Butt 101 is between butt 201 and latch 202. Latch 202 has a sloping end portion 205 in continuation of its edge 206 and which terminates in a point-like end 207. Hook 110 is provided at its end with a slot 119 within which end 207 of latch 202 is received. Slope 205 of latch 202 faces slope 117 of segment 109 and intersects therewith at about the mid point of slope 117 in the closed position of the needle in FIGS. 1 and 3. Latch 202 above line 208 at segment 203 is of reduced thickness so that it can be received within slot 111, FIG. 7. Below line 208 the hook section 10 and latch section 20 are of equal thickness, FIG. 6.

Hook section 10 and latch section 20 are assembled to form the sliding latch needle of the present invention which is shown in closed position in FIG. 1 and in open position in FIG. 2. With latch 202 at an angle to segments 107, 108, the free end thereof is caused to extend through aperture 114 and into slot 111. Thereafter the latch is turned to its position of FIG. 3 with edge 206 of the latch bottomed against bottom 112 of slot 111 and with segment 203 of the latch section abutting against surface 116 of segment 107. In this manner radial movement of latch 202 outwardly of the needle cylinder slots is prevented. It will be noted that butts 101, 201 extend in the same plane radially of the needle cylinder and that shank 204 of the latch section is interposed between the bottoms of the needle slots of the machine and the meanderform segments of the hook section.

Referring to FIGS. 8A, 8B, 8C and 8D, the first example of the present invention is shown in FIG. 8A while second, third and fourth examples thereof are shown in FIGS. 8B, 8C and 8D. The latter examples differ from the first example in that their hook and latch sections, 10A–20A, 10B–20B and 10C–20C are progressively longer than the hook and latch sections 10–20 of the first example. Accordingly, operating butts 101–201, 101A–201A, 101B–201B and 101C and 201C are at four separate levels on the needles. Patterned fabric can be knit upon the needles of FIGS. 8A through 8D by selective disposition thereof in relation to knitting cams at the four operating butt levels.

The fifth example of the present invention is shown in FIG. 9 wherein the shank of the latch section 20D is elongated and is provided with a single operating butt 201D at its butt end. The shank of hook section 10D is also elongated and is provided with operating butts 101D1, 101D2, 101D3 and 101D4 disposed at four uniformly spaced levels thereof. It is intended that three of the four butts on the hook shank are to be removed to leave single butts on the hook shank at selected levels. Patterned fabric can be knit upon the single butt needles by selective disposition thereof in relation to knitting cams at the four butt levels.

The sixth example of the present invention as shown in FIG. 10 is generally similar to the fifth example of FIG. 9 in the provision and the function of operating butts 201E, 101E1, 101E2, 101E3 and 101E4 of hook section 10E and latch section 20E. The upper ends of hook and latch sections 10E and 20E, as shown in FIG. 11, differ from the corresponding upper hook and latch sections 10 and 20 shown in FIGS. 3, 4 and 5. The basic difference is that a second slot 111E spaced from and aligned with first slot 111 has been formed and a latch extension 202E depending from latch 202 has been added. Slot 111E is formed in segments 106E, 107E with a portion therebetween having surface 116E against which latch 202 and extension 202E abut as the needle moves lengthwise in its slot in the needle cylinder. Latch 202 slides along bottom 112 of latch slot 111 while extension 202E slides along bottom 112E of slot 111E. Latch 202 and extension 202E, to the right of line 116E, are thinner than shank 204E so as to slide along slots 111 and 111E. There is a second aperture extending through the needle between 121E and 116E, inaddition to the first aperture 114. Surface 116E prevents movement of latch 202 and its extension radially outwardly of the needle slots. As in the fifth example, FIG. 9, a single butt 201E may be provided on latch section 20E and four butts 101E1, 101E2, 101E3 and 101E4 may be provided on hook section 10E. By retaining one of the four butts and removing the other three, the needle can be used for patterned knitting.

Seventh and eighth examples of the present invention are shown in FIGS. 12 and 13, and FIG. 14 is an enlarged sectional view of FIG. 2 at 14 thereof. In these examples the disposition of hook section 10F and latch section 20F are interchanged as compared to their relation in the first example of the invention. The hook and latch sections are reversed in the needle slots of the machine and 201F is now above butt 101F. An extra slot 111F is formed at the juncture of segments 106F and 107F of the hook shank and extends through these segments in alignment with slot 111. Latch 202F above line 208F is thinner than shank 204F and extends through slot 111F and into slot 111. In the example shown in FIG. 12, hook section 10F and latch section 20F have one butt 101F and 201F respectively and may be used for plain knitting of Jersey fabric. However, as in FIG. 13, four butts 101G1, 101G2, 101G3 and 101G4 can be formed at separate levels on hook section 10G. By removing three of the four butts a single butt will remain at a selected level and the needle can be used for patterned knitting.

It will be noted that the present construction is particularly effective in preventing the latch 202 from moving radially outwardly of the machine, by centrifugal force, away from hook 110 and thereby to prevent mis-stitches in the knitting operation. As in FIG. 4, the latch abuts against surface 116, in FIG. 11 supporting surface 112E of slot 111E supports extension 202E of the latch which also abuts against surface 116E. It will also be noted that in the first six examples of the invention the total needle length can be made shorther because the hook section butts are located above the latch section butts.

We claim:

1. A sliding latch needle assembly comprising cooperative hook and latch sections, the hook section having an elongated shank member with a hook at one end thereof and an operating butt extending from its other end, and the latch section also having an elongated shank member with a latch at one end thereof and an operating butt extending from its other end, the butts extending in like direction from the shank members corresponding thereto with the hook butts disposed between the latch butts and the latch.

2. A sliding latch needle assembly as in claim 1 wherein a slot is formed in the shank of the hook section adjacent the hook end thereof, and wherein at least a part of the slot forms an aperture extending through the shank of the hook section between the butt and the non-butt sides thereof.

3. A sliding latch needle assembly as in claim 2 wherein the latch extends through the aperture and into the slot from the non-butt side of the hook section.

4. A sliding latch needle assembly as in claim 3 wherein the butt side of the latch section abuts against the hook section adjacent to the aperture, thereby to prevent movement of the latch away from the hook.

5. A sliding latch needle assembly as in claim 1 wherein the needle in use reciprocates in the cylinder slots of circular knitting machines, wherein the latch section is guided by the bottom and the side walls of the slots, and wherein the hook section is guided by the latch section and the side walls of the slots.

6. A sliding latch needle assembly as in claim 1 wherein at least the hook shank is formed of staggered lengthwise extending segments the ends of which are joined by laterally extending segments.

* * * * *